United States Patent [19]

Okuya

[11] 4,172,248

[45] Oct. 23, 1979

[54] VARIABLE RESISTOR AND DRIVING MECHANISM THEREFOR

[75] Inventor: Tsutae Okuya, Miyagi, Japan

[73] Assignee: Alps Electric Co., Ltd., Japan

[21] Appl. No.: 920,552

[22] Filed: Jun. 29, 1978

[30] Foreign Application Priority Data

Jul. 1, 1977 [JP] Japan ..... 52-87406[U]

[51] Int. Cl.[2] ..... H01C 10/38

[52] U.S. Cl. ..... 338/176; 338/183

[58] Field of Search ..... 338/176, 160, 161, 183, 338/188, 194; 29/610

[56] References Cited

U.S. PATENT DOCUMENTS

| | | | |
|---|---|---|---|
| 2,273,760 | 2/1942 | Nelson | 338/183 X |
| 2,627,593 | 2/1953 | Tietig | 338/176 X |
| 2,900,615 | 8/1959 | Gottschall et al. | 338/176 |
| 2,909,750 | 10/1959 | Pitzer | 338/176 |

FOREIGN PATENT DOCUMENTS

| | | | |
|---|---|---|---|
| 86667 | 12/1975 | Japan | 338/176 |

*Primary Examiner*—C. L. Albritton

*Attorney, Agent, or Firm*—Guy W. Shoup; Gerard F. Dunne

[57] ABSTRACT

Disclosed is a variable resistor of a simple construction having a driving mechanism, which can be assembled with ease and which allows contactors movable by an operation lever to be normally held in a predetermined position on a resistance element. The lever can be forcibly moved to vary the output of the resistor, and yet the lever will be returned automatically to its original position when the lever is released from the force exerted thereon.

8 Claims, 4 Drawing Figures

VARIABLE RESISTOR AND DRIVING MECHANISM THEREFOR

BACKGROUND OF THE INVENTION

1. Field of the Invention

The present invention relates to variable resistors and, more particularly, to a driving mechanism for variable resistors, which allows contactors movable by an operation lever to be normally held in a predetermined position on resistance elements when the lever is not operated. The output value of the resistor can be varied when the lever is operated, but the lever will be returned automatically to its original position when the force moving the lever is released.

2. Description of the Prior Art

A variable resistor for controlling servomechanisms, which has a sliding contact member in contact with a resistor element and capable of being automatically returned to the central position is known. When the sliding contact member in such a variable resistor is returned to the central position, the output thereof is zero volt.

A variable resistor provided with a spring as a means for automatically returning a sliding contact member is known, for example, as described in Japanese Laid-Open Pat. No. 86667/1975.

However, known variable resistors, such as that described in the above-mentioned Japanese patent, have to be provided with a grounding means and they have a complicated construction. Moreover, they have a large number of parts and are very difficult to assemble.

SUMMARY OF THE INVENTION

An object of the present invention is to eliminate the above-mentioned drawbacks encountered in the prior art variable resistors.

To this end, according to the present invention, there is provided a driving mechanism for a variable resistor, comprising a frame, and an insulating base plate secured to the frame and provided with resistance elements and conductive members. Contactors held in a slider are slidable on the resistance elements and the conductive members and the slider are fixed to a lever for moving the same. A guide rod is disposed along the path of the lever. A stop portion is carried by a predetermined portion of the guide rod, and two driving members are mounted on the guide rod so that they are on respective sides of the lever and the stopper. Springs are mounted on the guide rod and urge the driving members against the stopper.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
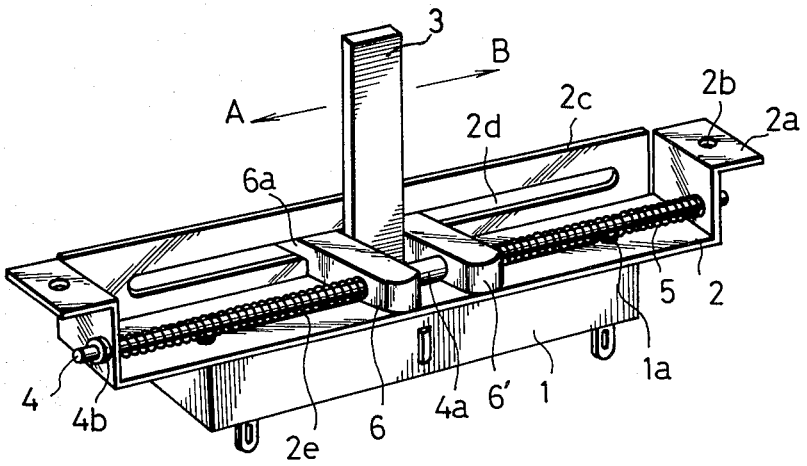
FIG. 1 is a perspective view of an embodiment of the present invention.
Figure 2:
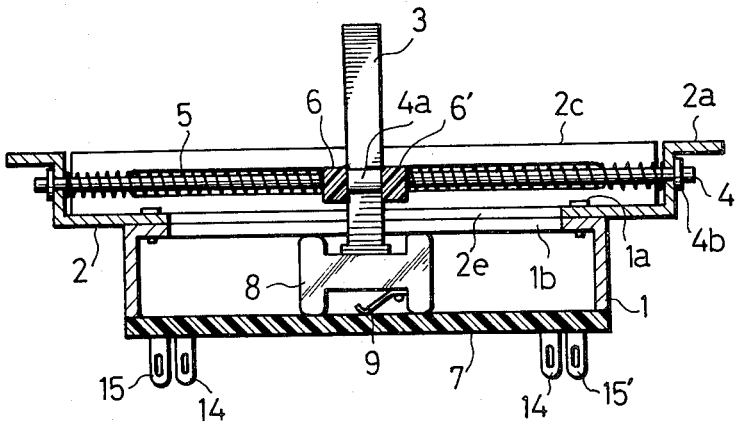
FIG. 2 is a side elevational view in cross section of the embodiment shown in FIG. 1.

An embodiment of the present invention will be described with reference to the accompanying drawings.

Referring to the drawings, reference numeral 1 denotes a rectangular case for the variable resistor, and 2 denotes a metal frame which may be secured to the upper wall of the case 1 by means of screws 1*a*. The frame 2 is provided at its ends with respective stepped mounting portions 2*a* each having a screw hole 2*b* for mounting the variable resistor to a control panel of a machine in which the variable resistor is to be used, for example as part of a servomechanism. The frame 2 is further provided at the rear side thereof with an upstanding wall portion 2*c* having an elongate longitudinal slot 2*d* for receiving the end or guide portions 6*a* of the driving members 6 to be described later. The frame 2 is further provided in the bottom wall thereof with an elongate slot 2*e* which is aligned with and coextensive with an elongate slot 1*b* provided in the top wall portion of the case 1.

An operation lever 3 is fixed to a contactor receiver or slider 8 and has an upstanding portion projecting through the slots 1*b* and 2*e*, and is movable therealong in the directions of the arrows A and B.

Reference numeral 4 denotes a guide rod which is supported on the upstanding portions of the stepped mounting portions 2*a*. Stopper rings 4*b* secured to respective ends of the guide rod 4 maintain the rod in position. The guide rod 4 has a stop portion 4*a* formed integrally on the central portion thereof. The stop portion 4*a* has a diameter greater than that of the remainder of the rod 4 and will regulate the movement of the driving members 6, as will be described below.

On the guide rod 4, two driving members 6 and 6' are mounted at right angles thereto so that they are on respective sides of the lever 3. On those portions of the guide rod 4 that are between the driving members 6, 6' and the mounting portions 2*a*, respective coil springs 5 are mounted.

Figure 3:
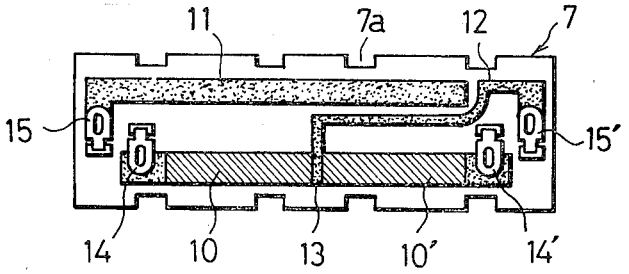
FIG. 3 is a plan view of the base plate of the embodiment shown in FIG. 1.

Referring to FIG. 3 an insulating base plate 7 has resistance elements 10 and 10' separated by one end portion of a conductive member 13, as well as a conductive member 11 parallel to the resistance elements 10 and 10'. One end of each of the resistance elements 10 and 10' is connected to respective terminals 14 and 14', and one end of the conductive member 11 is connected to a terminal 15. The conductive member 13 extending between the resistance elements 10 and 10' is connected to grounding terminal 15' via a conductive member 12. The resistance elements and conductive elements may be formed on the base plate 7 by any suitable means, such as by printing.

Reference numerals 7*a* denote recesses provided in the peripheral portion of the base plate 7 for use in securing the base plate 7 to the case 1 in a known manner. Reference numeral 8 denotes a contactor receiver made of an insulating material and having at the lower surface thereof a plurality of contactors 9 which are slidable respectively on the resistance elements 10, 10' and the conductive member 11.

The operation of the variable resistor according to the present invention, which consists of the above-mentioned parts, will be described below.

When the lever 3 is not in operation, the two driving members 6 and 6' disposed on both sides thereof are urged by the springs 5 against the outer shoulder portions of the stop portion 4a, whereby the driving members 6 and 6' are held in position.

The stop portion 4a is centered along an imaginary line equi-distant from the inner ends of the two resistance elements 10 and 10'. With the lever 3 aligned with this imaginary line, one of the plurality of contactors 9 is on that portion of the conductive member 11 which is also aligned with the imaginary line and another contactor 9 is on that portion of the conductive member 13 that extends between the resistance elements. At this time, the electric potential across any of the output terminals is effectively zero.

Figure 4:
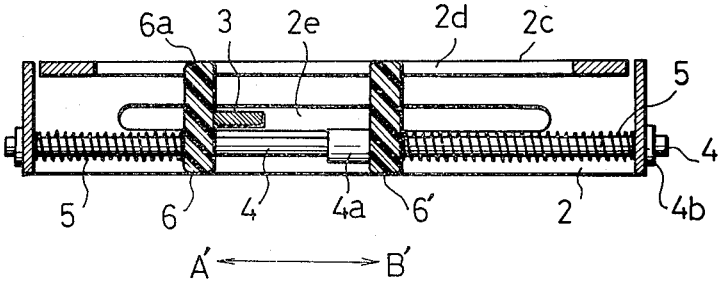
FIG. 4 is a plan view of principal portions of the embodiment shown in FIG. 1 as shown in operation.

When the lever 3 is forcibly moved against the force of one of the springs 5 along the slot 2e in the direction an arrow A' as shown in FIG. 4, the driving member 6 is thereby moved on the guide rod 4 and along the slot 2d in the same direction. The contactor receiver 8 is also moved with the lever 3 in the same direction. At this time, the contactors 9 slid on the resistance element 10 and conductive member 11 to adjust the voltage across the terminals 14 and 15 to a desired value.

When the lever 3 is released, the spring urges the driving member 6 by the resilient force thereof in the direction of an arrow B', so that the lever 3 is urged by the driving member 6 in the same direction. When the lever 3 is thus returned to the original position, the driving member 6 contacts the stop portion 4a and the driving member 6 is prevented from being further moved in the direction B'. At this time, the lever is in the middle of its path while being held between the driving members 6 and 6' by the resilient forces of the springs 5. The voltage across any of the output terminals is now back to zero.

When the lever 3 is forcibly moved in the opposite direction, i.e. in the direction B', the driving member 6' is moved against the resilient force of the other of the springs 5 in the same direction by the same principle. This, of course, allows the contactors 9 to be slid on the resistance element 10' and the conductive member 11 so that the voltage can be changed.

Described above is an embodiment of the driving mechanism for variable resistors according to the present invention used for controlling a servomotor requiring voltage to be zero when the lever is in the middle or normal position of its path. However, the application of the driving mechanism of the present invention is not limited to the above-described one. The driving mechanism according to the present invention may also be applied to resistors for allowing the contactors to be in a predetermined position on a resistance element when the lever is not in operation, the voltage to be adjusted to a desired value when the lever is in operation, and the lever to be automatically returned to its original predetermined position when the lever is released from the force exerted thereon. This may be easily accomplished by employing a combination of the driving members 6 and 6', springs 5, and the stop portion 4a provided on the guide rod 4. In such a case, resistance elements of the pattern as shown in FIG. 3 are not necessary; resistance elements of the pattern used in conventional sliding variable resistors may be used. The employment of the springs 5 and stop portion 4a on the guide rod 4 permits the provision of a variable resistor of a simple construction in which the lever can be automatically returned to its original position.

The present invention is not, of course, limited to the above-described embodiment; it may be modified in various ways within the scope of the appended claims.

What is claimed is:

1. A driving mechanism for a variable resistor having a base plate carrying resistance elements and a conductive member, and a slider movable along said base plate and carrying contactors adapted to engage said resistance elements and said conductive member, said mechanism comprising a frame secured to said variable resistor;

an operation lever fixed for movement with said slider and having an upstanding portion extending through said frame;

a guide rod fixed to said frame and extending parallel to the path of movement of said upstanding portion;

a stop member located along said guide rod at a predetermined location;

two driving members each mounted for sliding movement on said guide rod and having drive portions lying adjacent a respective side of said upstanding portion; and a spring operatively associated with a respective driving member for urging it against said stop member.

2. A driving mechanism according to claim 1, said stop member being formed by an enlarged, integral portion of said guide rod.

3. A driving mechanism according to claim 1, said predetermined location being along the central portion of said guide rod.

4. A driving mechanism according to claim 1, said frame including an upstanding wall portion extending parallel to said guide rod and having a longitudinal slot formed therein, said driving members each having guide portions extending through said slot.

5. A driving mechanism according to claim 1, said frame having upstanding side wall portions each receiving a respective end portion of said guide rod, said springs each being coiled about said guide rod and having one end thereof engaging against a respective end wall portion and the other end thereof engaging against a respective driving member.

6. A driving member according to claim 1, said variable resistor including a case holding said base plate and having a top wall portion fixed to said frame, said frame and said top wall portion each having aligned, coextensive slots through which said upstanding portion extends.

7. A driving mechanism according to claim 1 or 3 said resistance elements comprising two resistance elements lying end to end on said base plate and having a conductive portion therebetween, said conductive portion adapted to be connected to electrical ground and being generally aligned with said predetermined location.

8. A driving mechanism according to claim 2, said predetermined location being along the central portion of said guide rod.

* * * * *